US009605617B2

(12) United States Patent
Suzuki et al.

(10) Patent No.: US 9,605,617 B2
(45) Date of Patent: Mar. 28, 2017

(54) METHOD AND SYSTEM FOR LOAD CONTROL DURING MISFIRE OF ENGINE

(71) Applicant: Mitsubishi Heavy Industries, Ltd., Tokyo (JP)

(72) Inventors: Hajime Suzuki, Tokyo (JP); Hideki Nishio, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 14/780,481

(22) PCT Filed: Feb. 19, 2014

(86) PCT No.: PCT/JP2014/053831
§ 371 (c)(1),
(2) Date: Sep. 25, 2015

(87) PCT Pub. No.: WO2014/156375
PCT Pub. Date: Oct. 2, 2014

(65) Prior Publication Data

US 2016/0047327 A1 Feb. 18, 2016

(30) Foreign Application Priority Data

Mar. 28, 2013 (JP) ..... 2013-069516

(51) Int. Cl.
*F02D 41/14* (2006.01)

(52) U.S. Cl.
CPC .. *F02D 41/1497* (2013.01); *F02D 2200/1015* (2013.01); *F02D 2250/26* (2013.01)

(58) Field of Classification Search
CPC ..... F02D 41/1497; F02D 41/1498; F02D 2200/1015; F02D 2250/26; G01M 15/11; G01M 15/12

(Continued)

(56) References Cited

U.S. PATENT DOCUMENTS

2009/0000589 A1* 1/2009 Weinzierl ..... F02B 75/06 123/192.2
2009/0118990 A1* 5/2009 Suzuki ..... B60K 6/24 701/111

(Continued)

FOREIGN PATENT DOCUMENTS

JP 2005009323 A 1/2005
JP 2007138831 A 6/2007

(Continued)

OTHER PUBLICATIONS

Notification Concerning Transmittal of International Preliminary Report on Patentability, App. No. PCT/JP2014/053831, Filed Feb. 19, 2014, Mailed Oct. 8, 2015, 15 Pages.

(Continued)

*Primary Examiner* — John Kwon
*Assistant Examiner* — Johnny H Hoang
(74) *Attorney, Agent, or Firm* — Berkeley Law & Technology Group, LLP

(57) ABSTRACT

An object is to provide a method and a system of controlling a load during misfire of an engine, whereby additional stress on a crank shaft is calculated from torsional vibration of the crank shaft to obtain an output limit rate, and an operation output of an engine is controlled on the basis of the output limit rate. The method includes: a first step of calculating additional stress on a crank shaft on the basis of a vector sum of crank-shaft torsional vibration vibratory force when the misfire is detected; a second step of determining whether the calculated additional stress on the crank shaft is less than an allowable stress with respect to the crank shaft; a third step of controlling an operation output of the engine to be reduced by a predetermined amount and returning to the first step if the calculated additional stress is greater than the allowable stress and obtaining an output limit rate by calculating the additional stress on the crank shaft if it is (Continued)

determined that the calculated additional stress on the crank shaft is less than the allowable stress with respect to the crank shaft; and a fourth step of controlling the operation output of the engine on the basis of the output limit rate.

8 Claims, 5 Drawing Sheets

(58) Field of Classification Search
USPC .... 123/192, 2, 349, 406.16, 406.21, 406.23, 123/406.27, 406.32; 701/111; 73/114.02–114.05, 114.07, 114.11
See application file for complete search history.

(56) References Cited

U.S. PATENT DOCUMENTS

| | | | | |
|---|---|---|---|---|
| 2009/0229897 | A1* | 9/2009 | Yutani | B60K 6/445 180/65.28 |
| 2009/0308145 | A1* | 12/2009 | Suzuki | B60K 6/40 73/114.04 |
| 2012/0232774 | A1* | 9/2012 | Minatoya | F02D 41/1498 701/105 |

FOREIGN PATENT DOCUMENTS

| | | | |
|---|---|---|---|
| JP | 2008002303 | A | 1/2008 |
| JP | 2008095514 | A | 4/2008 |
| JP | 2008190433 | A | 8/2008 |
| JP | 4247842 | B2 | 1/2009 |
| JP | 2010014065 | A | 1/2010 |
| JP | 4688916 | B2 | 2/2011 |
| WO | 2009107688 | A1 | 3/2009 |
| WO | 2014156375 | A1 | 10/2014 |

OTHER PUBLICATIONS

International Search Report, App. No. PCT/JP2014/053831, Filed Feb. 19, 2014, Mailed Jun. 3, 2014, 12 Pages.
Hirosawa, "Solution for Torsional Vibration Problem of Ship Shafting," Transactions of the Kokushikan University, Faculty of Engineering, vol. 7, 1974, 12 Pages.
Saitou, "Torsional Vibrations during Misfiring of Six-Cylinder Diesel Engine Fitted with Five Bladed Propeller," Memoirs of the Fukui Institute of Technology, vol. 38, 2008, 8 Pages.
Notification Concerning Submission, Obtention or Transmittal of Priority Documents, App. No. PCT/JP201/053831, Filed Feb. 19, 2014, Mailed Apr. 10, 2014, 1 Page.
Decision to Grant a Patent, App. No. JP2013-069516, Mailed Sep. 16, 2016, 6 Pages.

* cited by examiner

METHOD AND SYSTEM FOR LOAD CONTROL DURING MISFIRE OF ENGINE

TECHNICAL FIELD

The present invention relates to a method and system for load control during misfire of an engine. It especially relates to a method and a system for load control during misfire of an engine which detects misfire of a cylinder and performs output-limit operation for the engine on the basis of a detection result of misfire in a multi-cylinder diesel engine, a gas engine or the like, for instance.

BACKGROUND

For instance, in a multi-cylinder diesel engine or a multi-cylinder gas engine for power generation, if misfire takes place in a cylinder or a plurality of cylinders, an engine output is lowered to an output at which stable operation is possible simultaneously with detection of misfire by a misfire-detection unit, in order to continue stable operation of the engine.

Specifically, in a conventional multi-cylinder engine, when all cylinders are in a normal operation state and operating at the 100% output, if misfire occurs in two of the cylinders, the operation output level is lowered to a 50% output (90% output in a case of one cylinder) to operate the engine stably.

When misfire occurs in one or two cylinders, the torsional response amplitude of a crank shaft of an engine changes, and the aspect of the change in the torsional response amplitude is varied between the misfiring cylinders. Thus, the allowable maximum load of the engine due to misfire is varied between the misfire-occurring cylinders.

Thus, to optimize the operation output of an engine upon occurrence of misfire, it is important to evaluate and study the torsional response amplitude of the crank shaft.

Various evaluations and studies on torsional vibration have been provided as follows.

For instance, Non-patent Document 1 describes that torsional vibration is caused by rotation weights of a crank shaft which is a rotational shafting system, and there is a certain natural frequency depending on the strength of the shaft and the distribution condition of the rotation weights (Holzer method).

For instance, in a case where a shaft has N rotation weights, there are (N−1) natural frequencies having one node, two nodes, three nodes, . . . and (N−1) nodes. Here, one node means that the vibration has one node, and x nodes means that there are x nodes.

When the number of cycles of a vibratory force which causes the torsional vibration is the same as the natural frequency having x nodes, torsional vibration is caused by resonance.

The vibratory force is generated by a component-force vector, which is a sine wave vector obtained by analyzing a torque curve of an engine with a harmonic analyzer. Thus, torsional vibration appears as y-order torsional vibration with x nodes, determined by x, which is the number of nodes of vibration, and y, which is the order of the harmonic component-force vector that becomes the vibratory force.

Generally, when a relationship between a torque T and a torsional angle θ is explained referring to a shaft having a length L as a fixed end for fixing one end, the following equation is satisfied, in which a node point is the fixed end.

$$\theta = T \times L / G \times Ip \quad (1)$$

Here, T is a torque applied to the free end, G is a transverse elasticity coefficient of a material, and Ip is the polar moment of inertia of area with respect to an axial center.

According to the above equation, the torsional angle is proportional to the amplitude of the vibration. At each point of the shafting system, the amount of torsion of the shaft due to vector Ay of the harmonic component force is proportional to TL. Thus, a product of the harmonic vector Ay of each cylinder and a distance between the above node point and the cylinder is proportional to the total torsional angle of the shaft. That is, the magnitude of $\Sigma Ay \times L$ is proportional to the amplitude of the torsional vibration.

Here, each vector Ay has a phase between the respective cylinders. Thus, $\Sigma Ay \times L$ can be calculated by a graphical method using a TL vector chart.

The TL vector varies depending on the ignition order in a multi-cylinder engine. That is, if the crank arrangement and the ignition order of an engine are changed, the proportion magnitude CTL of the TL sum vector would become considerably different.

According to a result of performing harmonic analysis on a rotational-force torque T caused by one cylinder, the value of the harmonic component force Ay is varied depending on the order y. When the proportional magnitude here is CA, the vibratory force Cv of the vibration is:

$$Cv = CA \times CTL.$$

The amplitude of the torsional vibration is determined in proportion to Cv. By calculating Cv continuously, the magnitude of the vibration that should appear for each order of the torsional vibration can be predicted.

As described above, it is necessary to have advantageous ignition timing and crank arrangement on the basis of prediction of the torsional vibration that should appear in the shafting system. Since an ignition timing and a crank arrangement have a significant relationship with balancing of an engine, it is necessary to determine the most advantageous crank arrangement and ignition timing in view of both of the prediction of the torsional vibration and balancing.

Further, in Non-patent Document 2, the following study has been conducted on the torsional vibration during misfire of an engine with a five bladed propeller and six cylinders.

Here, among the methods for calculating torsional vibration response, a simulation calculation method to which a steady-state vibration method is applied is used to evaluate vibration and torsional vibration stress at a resonance rotation speed of a torque harmonic order. The characteristics of torsional vibration during misfire and the interaction between the engine vibratory force and the propeller vibratory force are evaluated through examples. The process will not be described here, and only the result of the study will be shown below.

For example, when misfire occurs in one cylinder in an engine equipped with six cylinders, the fourth, fifth, and sixth torque harmonics increase. As a result, the fourth and fifth components, which have small torsional vibration stress in normal ignition, increase. The increase of the torsional vibration stress of the fourth component is especially remarkable, and may exceed the predetermined allowable stress curve in some cases.

Thus, the applicant of the present invention discloses a method and a system for controlling a load during misfire of an engine in Patent Document 1, whereby it is possible to improve the availability of the engine upon occurrence of misfire by enabling setting the allowable maximum load on an engine during occurrence of misfire to be a suitable value for each cylinder in which misfire is occurring when misfire is occurring in one cylinder or a plurality of cylinders.

Further, in Patent Document 2, the applicant of the present invention proposes a method and a device for restricting a decrease in availability of an engine during occurrence of a misfire and restricting a decrease in efficiency of an engine power generation plant that accompanies deterioration in the fuel consumption rate of the engine.

Specifically, proposed here is a method and a system for performing output limit operation of an engine on the basis of a detection result of misfire of an engine equipped with a plurality of cylinders. On the basis of a detection signal of misfire, the first limit output, which is an output obtained by subtracting an output due to misfire corresponding to the number of cylinders with misfire from an output in normal operation, is calculated. Also, the second limit output is calculated on the basis of the detection signal of misfire using an output limit value that is set on the basis of a relationship of a change in torsional vibration and a cylinder with misfire that is set in advance. Then, the first limit output and the second limit output are compared to calculate the minimum limit output, and the engine is operated having the minimum limit output as the allowable maximum output during misfire.

As a result, a suitable output limit rate is determined so that the utilization rate of the engine decreases and it is possible to operate an engine at a low output that is beyond necessity, while the output of the engine is uniformly reduced by 50% in a conventional case when misfire is occurring in one or two cylinders.

CITATION LIST

Non-Patent Literature

Non-patent Document 1: Shingo Hirosawa. "Solution for Torsional Vibration Problem of Ship Shafting" The Annals of Faculty of Engineering of Kokushikan University 7 (1974).

Non-patent Document 2: Toshimasa Saito et al. "Torsional vibrations during Misfiring of Six-cylinder Diesel Engine Fitted with Five Bladed Propeller" The Annals of Fukui Industrial University 38 (2008).

Patent Literature

Patent Document 1: JP2008-95514A

Patent Document 2: JP2008-2303A

SUMMARY

Problems to be Solved

In view of this, the present applicant further advanced the technique of Patent Documents 1 and 2, focusing on the torsional vibration of the crankshaft, to arrive at a technique to determine a suitable output limit rate by obtaining an additional stress on a crank shaft on the basis of crank-shaft torsional vibration evaluation calculation, and to perform a control to achieve an appropriate engine output so that the utilization rate of the engine does not decrease in case misfire occurs to a part of cylinders.

The present invention was proposed in view of the above issues, and has an object to provide a method and a system for controlling load during misfire of an engine, whereby it is possible to perform load control operation during misfire by obtaining additional stress on a crank shaft on the basis of crank-shaft torsional vibration evaluation calculation and controlling the operation output of the engine in accordance with the additional stress when misfire occurs to a part of cylinders.

Solution to Problems

In order to achieve the above object, the present invention according to claim 1 provides a method of controlling a load during misfire of an engine for detecting misfire of a cylinder of an engine including a plurality of cylinders and controlling an operation output of the engine on the basis of a detection result of the misfire. The method includes: a first step of calculating additional stress on a crank shaft on the basis of crank-shaft torsional vibration evaluation calculation when the misfire is detected; a second step of obtaining an output limit rate for the engine corresponding to the calculated additional stress on the crank shaft; and a third step of controlling the operation output of the engine on the basis of the output limit rate.

In this way, when misfire occurs in a cylinder during operation of an engine, the balance in the operation of the engine is lost and the torsional vibration of the crank shaft varies. Thus, it is possible to calculate load stress on the crank shaft by performing crank-shaft torsional vibration evaluation calculation. It is possible to operate the engine at a suitable output during misfire by obtaining the output limit rate for the engine corresponding to the additional stress on the crank shaft and controlling the operation output of the engine on the basis of the output limit rate.

Further, in the present invention according to claim 2, the crank-shaft torsional vibration evaluation calculation in the first step is for calculating the additional stress on the crank shaft on the basis of a vector sum of a crank-shaft torsional vibration vibratory force.

As described above, since the crank-shaft additional stress is proportional to the vector sum of the crank shaft torsional vibratory force, it is possible to obtain the additional stress on the crank shaft during misfire from a proportional relationship between the value of the vector sum during misfire and the value of the vector sum of the crank-shaft torsional vibratory force during normal operation when misfire occurs to a cylinder during engine operation.

Further, in the present invention according to claim 3, the crank-shaft torsional vibration evaluation calculation in the first step is for calculating the additional stress on the crank shaft on the basis of a torsional angle of the crank shaft.

In this way, the vibration vibratory force being generated is varied depending on the position of the cylinder with misfire, and it is possible to obtain the torsional angle from the amplitude ratio corresponding to the vibratory force.

Once the torsional angle is known, it is possible to calculate the crank-shaft additional stress at the time from the vector sum of the corresponding torsional vibration vibratory force.

Further, in the present invention according to claim 4, the second step includes determining whether the calculated additional stress on the crank shaft is less than an allowable stress with respect to the crank shaft, and performing a control for reducing the operation output of the engine by a predetermined amount and return to the first step to execute the first step repeatedly if the calculated additional stress is greater than the allowable stress or calculating the additional stress on the crank shaft to obtain the output limit rate if it is determined that the calculated additional stress on the crank shaft is less than the allowable stress with respect to the crank shaft.

In this way, the operation output of the engine is controlled to decrease repeatedly by a predetermined amount so that the calculated additional stress on the crankshaft during misfire falls within the range of the allowable stress. Thus, it is possible to perform operation control of the engine without reducing the engine output beyond necessity.

Further, in the present invention according to claim 5, in the second step, the output limit rate is obtained on the basis of the calculated additional stress on the crank shaft and map data of an output limit rate corresponding to crank-shaft additional stress determined in advance.

In this way, it is possible to obtain the corresponding output limit rate from the map data in accordance with the calculated additional stress on the crank shaft. Thus, it is possible to operate the engine while immediately reducing the output to a suitable limited output.

Further, the present invention according to claim 6 provides a system for controlling a load during misfire of an engine configured to detect misfire of a cylinder of an engine including a plurality of cylinders and control an operation output of the engine on the basis of a detection result of the misfire. The system includes: a crank-shaft additional stress calculation part configured to calculate additional stress on a crank shaft on the basis of crank-shaft torsional vibration evaluation calculation when the misfire is detected; an additional-stress limit amount calculation part configured to obtain an output limit rate for the engine corresponding to the calculated additional stress on the crank shaft; and an engine output control part configured to control the operation output of the engine on the basis of the output limit rate for the engine calculated by the additional-stress limit amount calculation part.

In this way, when misfire occurs in a cylinder during operation of an engine, the balance in the operation of the engine is lost and the torsional vibration of the crank shaft varies. Thus, it is possible to calculate additional stress on the crank shaft by performing crank-shaft torsional vibration evaluation calculation with the crank-shaft additional stress calculation part. Next, it is possible to operate the engine at a suitable output during misfire by obtaining the output limit rate for the engine corresponding to the additional stress on the crank shaft with the additional-stress limit amount calculation part and controlling the operation output of the engine on the basis of the output limit rate with the engine output control part.

Further, in the present invention according to claim 7, the crank-shaft additional stress calculation part is configured to calculate the additional stress on the crank shaft on the basis of a vector sum of a crank-shaft torsional vibration vibratory force.

As described above, since the crank-shaft additional stress is proportional to the vector sum of the crank shaft torsional vibratory force, it is possible to obtain the additional stress of the crank shaft during misfire from a proportional relationship between the value of the vector sum during misfire and the value of the vector sum of the crank-shaft torsional vibratory force during normal operation with the crank-shaft additional stress calculation part when misfire occurs to a cylinder during engine operation.

Further, in the present invention according to claim 8, the crank-shaft additional stress calculation part is configured to calculate the additional stress on the crank shaft on the basis of a torsion angle of the crank shaft.

In this way, once occurrence of misfire in a cylinder is detected, the crank-shaft additional stress calculation part can calculate the crank-shaft additional stress on the basis of a torsional angle of the crank.

Further, in the present invention according to claim 9, the additional-stress limit amount calculation part is configured to determine whether the calculated additional stress on the crank shaft is less than an allowable stress with respect to the crank shaft, and to issue a command to reduce the operation output of the engine by a predetermined amount if the calculated additional stress on the crank shaft is greater than the allowable stress or calculate the additional stress on the crank shaft if it is determined that the calculated additional stress on the crank shaft is less than the allowable stress with respect to the crank shaft.

In this way, the operation output of the engine is controlled to decrease repeatedly by a predetermined amount by the additional-stress limit amount calculation part so that the calculated additional stress on the crankshaft during misfire falls within the range of the allowable stress. Further, the limit amount of the additional stress on the crank shaft is calculated when the additional stress on the crank shaft falls within the range of the allowable stress. Thus, it is possible to perform an operation control of the engine without reducing the engine output unnecessarily.

Further, in the present invention according to claim 10, the additional-stress limit calculation part is configured to extract the output limit rate corresponding to the additional stress on the crank shaft, referring to the calculated additional stress on the crank shaft calculated by the crank-shaft additional stress calculation part and a data part on map of an output limit rate corresponding to crank-shaft additional stress determined in advance.

In this way, the output limit rate to be limited can be extracted from the calculated crank-shaft additional stress and the data part on map of the output limit rate corresponding to crank-shaft additional stress determined in advance. On the basis of such output limit rate, it is possible to control the operation output of the engine with the engine output control part.

Advantageous Effects

According to the present invention, crank-shaft torsional vibration evaluation calculation is performed using the torsional vibration caused by misfire in a cylinder. The additional stress on the crank shaft is calculated, and the output limit rate of the engine corresponding to the change in the additional stress is derived. The output of the engine is controlled on the basis of this output limit rate. In this way, it is possible to avoid unnecessary low-load operation of the engine to improve the fuel consumption rate. Thus, improvement of efficiency of the engine power generation plant can be expected.

DETAILED DESCRIPTION

The method and system of controlling a load during misfire of an engine according to the present invention will now be described in detail with reference to embodiments and the accompanying drawings.

First Embodiment

Figure 1:
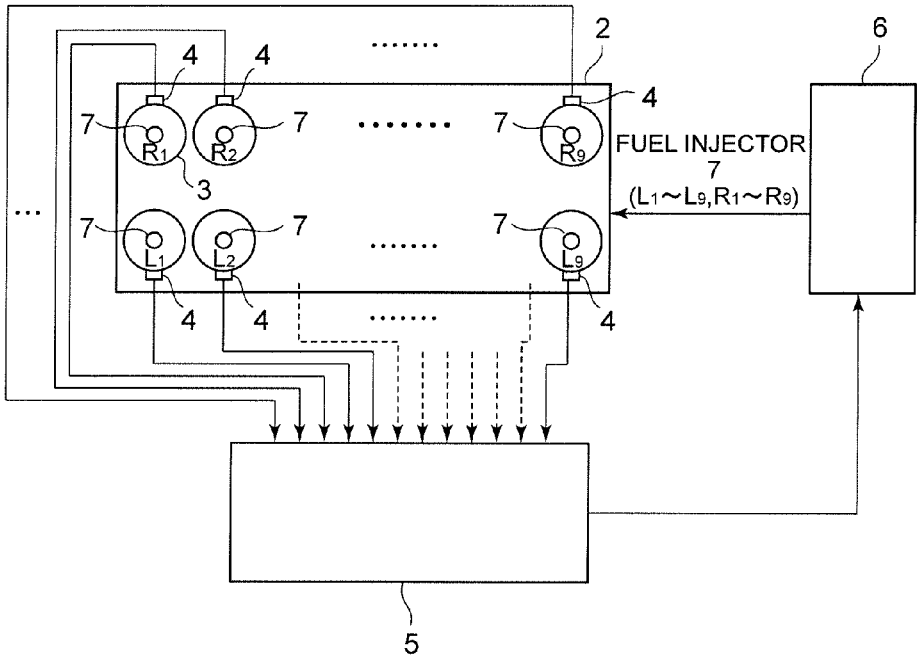
FIG. 1 is a block diagram of an overview of a load control system at misfire according to the first embodiment for executing a method of controlling a load during misfire for an engine according to the present invention.
Figure 2:
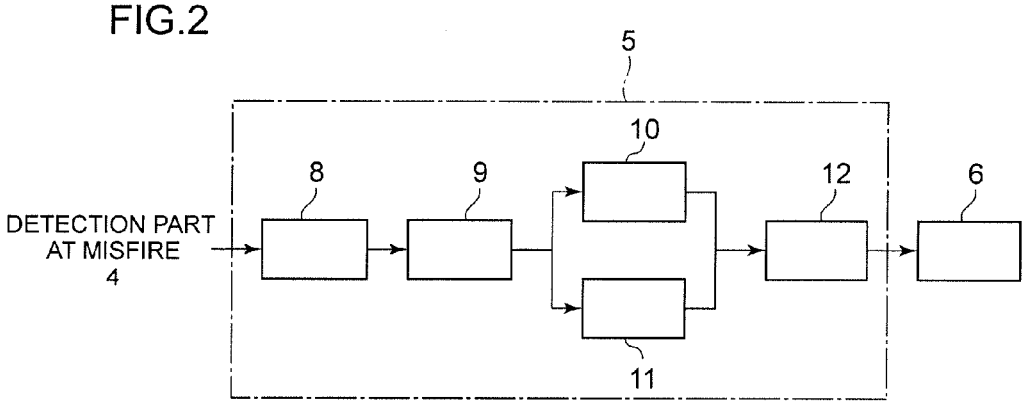
FIG. 2 is a detailed block diagram of a misfire controller according to the first embodiment.

FIG. 1 is a diagram of a load control system at misfire 1 for executing a method of controlling a load during misfire for an engine according to the first embodiment.

The load control system at misfire 1 is configured to control the output during misfire by detecting misfire of a plurality of cylinders 3 mounted to an engine 2. The load control system at misfire 1 includes a detection part at misfire 4 for detecting misfire, a misfire controller 5, and a fuel-injection control part 6.

While the engine 2 represents a V-form multi-cylinder (18-cylinder) diesel engine for power generation in the present example, the engine 2 may be a multi-cylinder gas engine or a multi-cylinder gasoline engine.

The engine 2 includes 18 cylinders 3 arranged in two V-form rows (L1, L2, . . . L9) and (R1, R2, . . . R9). Each cylinder 3 includes a fuel injector 7 for injecting fuel into each cylinder 3.

The fuel injector 7 controls the amount of fuel injection and the timing of fuel injection via a fuel injection control part 6 on the basis of an engine-output load control signal under a control of the misfire controller 5 described below.

A detection part at misfire 4 is provided for each of the cylinders 3. Each detection part at misfire 4 detects occurrence of misfire of each cylinder 3 by, for instance, detecting a change in an in-cylinder pressure or the like. Detection signals of occurrence of misfire in each cylinder 3 from such detection part at misfire 4 are inputted into the misfire controller 5.

Now, the misfire controller 5 will be described.

The misfire controller 5 includes a crank-shaft additional stress calculation part 8, a crank-shaft additional stress determination part 9, an engine output reduction command part 10, an additional stress limit amount calculation part 11, and an engine output control part 12.

The crank-shaft additional stress calculation part 8 receives detection signals from the detection part at misfire 4, and calculates additional stress on the crank shaft on the basis of a vector sum VS of a crank-shaft torsional-vibration vibratory force as crank-shaft torsional vibration evaluation calculation from torsional vibration caused by misfire of a cylinder. As to such vector sum VS of the crank-shaft torsional-vibration vibratory force, it is known that crank-shaft torsional vibration upon normal ignition and upon abnormal ignition, i.e., misfire, have a predetermined value, and additional stress on the crank shaft at this time also have a predetermined value. Further, the vector sum VS varies depending on the corresponding misfire cylinders (L1, L2, . . . L9) (R1, R2, . . . R9) or combination of the cylinders. Thus, with each vector sum VS stored in advance as map data, it is possible to extract a vector sum on the basis of the corresponding misfire cylinder, and to calculate additional stress at this time easily from a proportional relationship to the vector sum VS of the crank-shaft torsional vibration vibratory force upon normal ignition.

Figure 3:
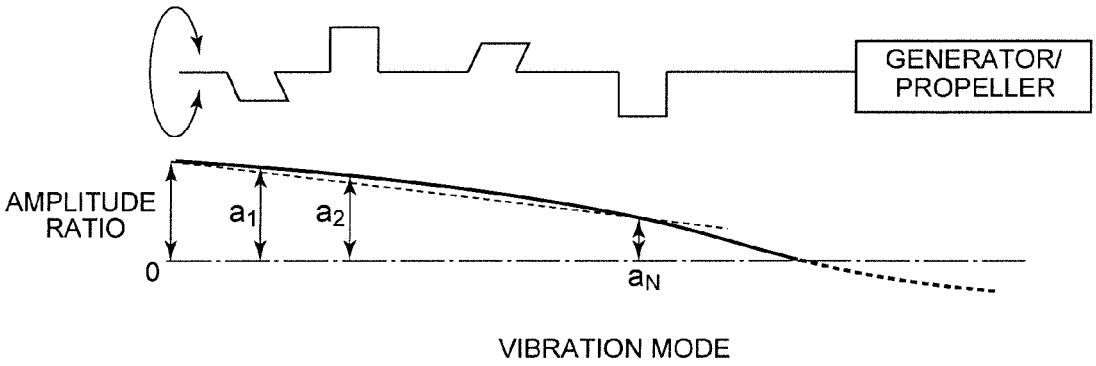
FIG. 3 is a diagram for describing torsional vibration of a crank shafting system by illustrating an example of a crank shaft.

Now, with regard to crank-shafting system torsional vibration, an example of a crank shaft is illustrated in FIG. 3 as a reference, and a vector sum of a crank-shaft torsional vibration vibratory force for calculating additional stress on the crank shaft will be described as crank-shaft torsional vibration evaluation calculation.

In FIG. 3, the amplitude ratio of torsional vibration of the first node mode is represented by a solid line. Linear approximation is possible as indicated by a dotted line. Similarly, linear approximation is also possible for the second node.

The torsional vibration vibratory force applied to a crank in each cylinder is proportional to the amplitude ratio. Thus, in a case of the first or second node mode in which the influence is the largest, the torsional vibration vibratory force may be considered as being proportional to a vp vector (an amplitude mode (engine part) vector of torsional vibration of each node) indicating a coordinate in the crank longitudinal direction of the crank.

It may be possible to evaluate a vector sum of the m-order torsional vibration vibratory force assuming that the vector sum is proportional to <vpN, θmN>. Here, the order is m=1, 2, 3, 4 . . . in a two-cycle engine and m=0.5, 1, 1.5, 2 . . . in a four-cycle engine. Here, er=[a1, a2 aN], θrmN=[1exp (j·mθ2) . . . exp(j·mθn)], n=N−1.

The crank-shaft additional stress determination part 9 determines whether the crank-shaft additional stress calculated by the crank-shaft additional stress calculation part 8 is less than allowable stress with respect to the crank shaft.

Further, the engine output reduction command part 10 outputs a command for reducing the operation output of the engine by a predetermined amount to an engine output control part 12 described below, if the crank shaft additional stress determined by the crank-shaft additional stress determination part 9 is greater than the allowable stress.

The additional stress limit amount calculation part 11 calculates a limit amount of additional stress on the crank shaft, if the calculated crank-shaft additional stress is less than the allowable stress with respect to the crank shaft.

The engine output control part 12 outputs an engine output load control signal on the basis of the command to reduce the operation output of the engine by a predetermined amount from the above engine output reduction command part 10 and the additional stress limit amount calculated by the additional stress limit amount calculation part 11, thereby controlling the amount of fuel injection and the timing of fuel injection via the fuel injection control part 6.

Figure 4:
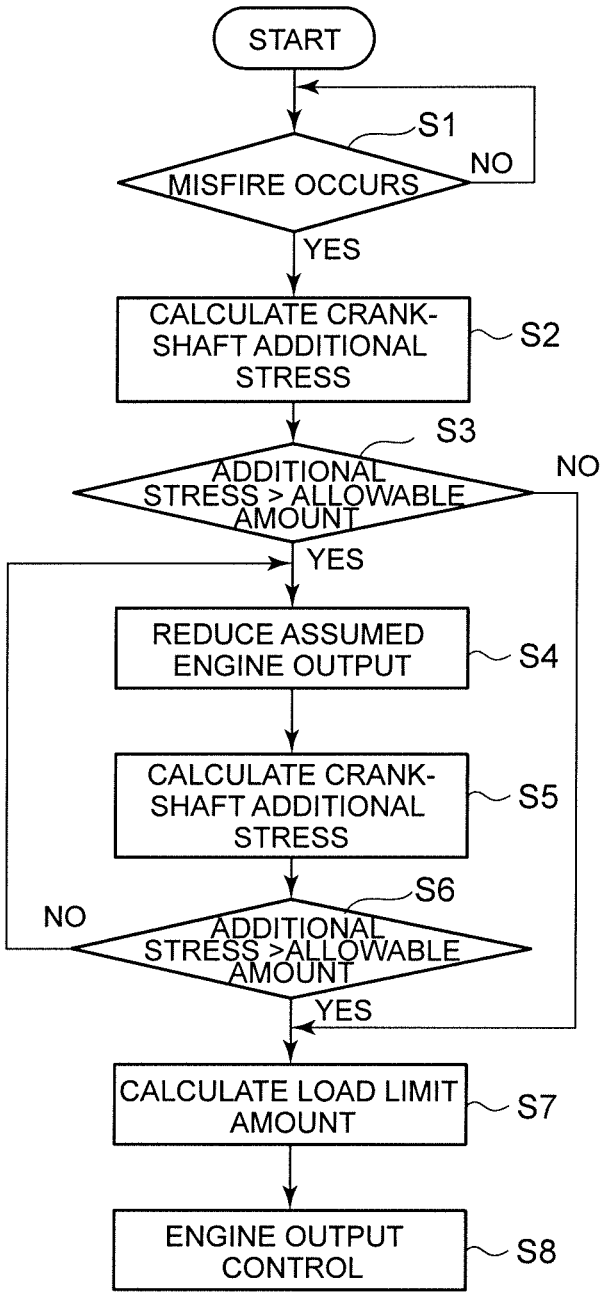
FIG. 4 is a flowchart of an example for executing a method of controlling a load during misfire according to the first embodiment.

With regard to the above load control system at misfire 1 according to the first embodiment, operation of the method of controlling a load during misfire of an engine will be described with reference to the flowchart of FIG. 4.

In the first stage, for each cylinder 3 of the engine 2, misfire is monitored at an engine start by the corresponding detection part at misfire 4. If misfire is detected (step S1), a misfire detection signal is inputted from the cylinder 3 in which misfire is occurring into the crank-shaft additional stress calculation part 8 of the misfire controller 5.

The crank-shaft additional stress calculation part 8 determines the misfire cylinder 3 from the detection signal from the detection part at misfire 4, as shown in step S2. For instance, from the group of cylinders (L1, L2, . . . L9) (R1, R2, . . . R9), it is determined whether the misfire cylinder is L1 or L2, or L1 and R1 or L2 and R2, and then a signal related to the determination is outputted.

In the crank-shaft additional stress calculation part 8, since the vector sum VS of the crank-shaft torsional vibration vibratory force has a predetermined value of crank-shaft torsional vibration during normal ignition and during misfire, the vector sum VS corresponding to the misfire cylinder 3 is stored. Thus, it is possible to extract the vector sum VS of the misfire cylinder 3, and to calculate easily the additional stress at this time from a proportional relationship to the vector sum VS of crank-shaft torsional vibration vibratory force during normal ignition.

For instance, if misfire occurs in a cylinder 3 when a vector sum VS of crank-shaft torsional vibration vibratory force during normal ignition is 0.085, the vector sum VS determined by the ignition order, bearing stress, and crank stress loses balance and the value increases. For instance, if the vector sum is 1.394 when the misfire cylinders are L1 and R1, this value is 16.4 times larger than the vector sum VS 0.085 during normal ignition. Accordingly, the crank-shaft additional stress when the misfire cylinders are L1 and R1 is 16.4 times the crank-shaft additional stress during normal ignition.

Next, in the second stage, a signal related to the crank-shaft additional stress calculated by the crank-shaft additional stress calculation part 8 is outputted, and the crank-shaft additional stress determination part 8 determines whether the crank-shaft additional stress is larger or smaller than the allowable stress with respect to the crank shaft (step S3).

If the crank-shaft additional stress determined by the crank-shaft additional stress determination part 9 is greater than the allowable stress, the engine output reduction command part 10 outputs a command to reduce the operation output of the engine by a predetermined amount to the engine output control part 12 (step S4).

On the other hand, if the crank shaft additional stress is less than the allowable stress, the crank shaft additional stress is outputted to the additional stress limit amount calculation part 11, which calculates a limit amount of the additional stress with respect to the crank shaft (step S7).

In step S4, after the engine output reduction command part 10 outputs a command to reduce the operation output of the engine by a predetermined amount to the engine output control part 12 and the engine 2 is operated to reduce the output, similarly to the first stage, the crank-shaft additional stress is calculated by the crank-shaft additional stress calculation part 8 again by the torsional vibration calculation (step S5).

Then, the crank-shaft additional stress determination part 9 determines whether the crank-shaft additional stress calculated again is greater or smaller than the allowable stress with respect to the crank shaft (step S6).

If the crank-shaft additional stress is still larger than the allowable stress in step S6, a command is outputted to the engine output control part 12 in step S4 to reduce the operation output of the engine by a predetermined amount.

If the crank-shaft additional stress is less than the allowable stress, the crank-shaft additional stress is outputted to the additional stress limit amount calculation part 11, which then calculates the limit amount of the additional stress with respect to the crank shaft (step S7).

Then, in the third step, the engine output control part 12 outputs an engine output load control signal, which makes it possible to control the amount of fuel injection and the timing of fuel injection via the fuel injection control part 6 (step S8).

As described above, according to the first embodiment, when the engine 2 is operated, in the load control system at misfire 1, the detection part at misfire 4 disposed on each cylinder 3 of the engine 2 detects misfire, and the misfire cylinder 3 is determined. Further, since the crank-shaft additional stress is proportional to the vector sum of the crank shaft torsion vibratory force, it is possible to obtain the additional stress on the crank shaft during misfire from a proportional relationship between the value of the vector sum during misfire and the value of the vector sum of the crank-shaft torsional vibratory force during normal operation.

It is possible to perform operation while controlling the operation output of the engine so that the above additional stress does not exceed the allowable stress. Thus, it is possible to perform appropriate load control operation of an engine during occurrence of misfire.

As a result, it is possible to improve the fuel consumption rate and expect improvement of the efficiency of the engine power generation plant by enabling operation with an allowable minimum operation output and avoiding unnecessary low-load operation of the engine in order to continue stable operation of an engine when misfire occurs.

The method and system of controlling a load during misfire of an engine according to the present invention can be implemented as the following second embodiment. Here, the targeted engine includes 18 cylinders 3 arranged in two V-form rows (L1, L2, . . . L9) (R1, R2, . . . R9), similarly to the first embodiment. Each cylinder 3 includes an engine 2 including a fuel injector 7 for injecting fuel into each cylinder 3.

Second Embodiment

Figure 5:
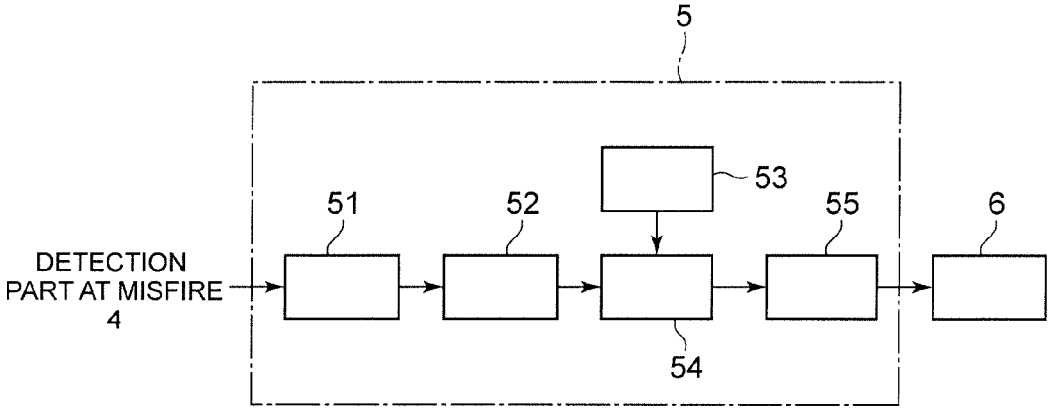
FIG. 5 is a detailed block diagram of a misfire controller according to the second embodiment.

FIG. 5 is a diagram of the load control system at misfire 1 according to the second embodiment.

In the second embodiment, the misfire controller 5 includes a measurement part 51 which obtains a torsion angle of the crank shaft, a crank-shaft additional stress calculation part 52 which calculates the crank-shaft additional stress by calculating vibration from the torsion angle of the crank shaft obtained by the measurement part 51, a data part on map 53 of an output limit rate corresponding to crank-shaft additional stress determined in advance, an additional-stress extraction part 54 which extracts the output limit rate corresponding to the crank-shaft additional stress referring to the crank-shaft additional stress obtained by the crank-shaft additional stress calculation part 52 and the data part on map 53, and an engine output control part 55 which controls the operation output of the engine on the basis of the output limit rate from the additional stress extraction part 54.

The measurement part 51 receives a detection signal of occurrence of misfire from the detection part at misfire 4 disposed on each cylinder 3, and obtains the torsion angle of the crank shaft at the position of the cylinder 3.

Since the torsional vibration vibratory force applied to the crank of each cylinder is proportional to the amplitude ratio, different torsional vibration vibratory forces are generated depending on the position of the cylinder 3 with misfire, and it is possible to obtain the torsional angle from the amplitude ratio corresponding to the vibratory force.

Further, the torsional vibration vibratory force is obtained from the torsion angle of the crank shaft obtained by the measurement part 51, and the vector sum VS of the crankshaft torsional vibration vibratory force has a predetermined value of the crank-shaft torsional vibration during misfire as compared to during normal ignition, similarly to the first embodiment. Thus, the crank-shaft additional stress calculation part 52 can calculate crank-shaft additional stress (MPa) at this time.

Further, an engine output limit rate (%) corresponding to the crank-shaft additional stress (MPa) is accumulated in advance in the data part on map 53. Specifically, if the crank-shaft additional stress is known, it is possible to extract a suitable output limit rate.

Further, the additional stress extraction part 54 extracts the output limit rate corresponding to the crank-shaft additional stress with reference to the crank-shaft additional stress obtained by the crank-shaft additional stress calculation part 52 and the data part on map 53.

The engine output control part 55 can control the operation output of the engine on the basis of the output limit rate from the additional stress extraction part 54.

Figure 6:
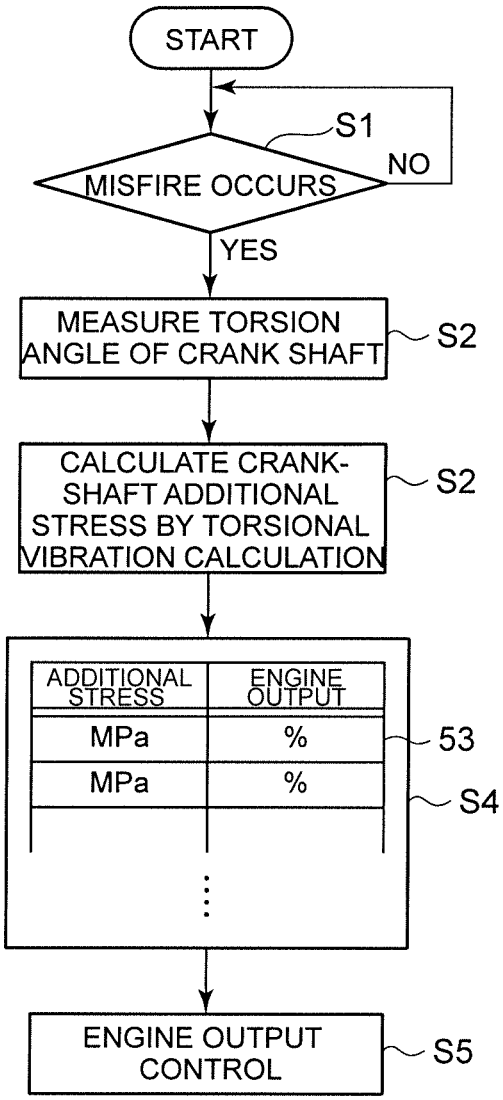
FIG. 6 is a flowchart of an example for executing a method of controlling a load during misfire according to the second embodiment.

With regard to the above load control system at misfire 1 according to the second embodiment, operation of the method of controlling a load during misfire of an engine will be described with reference to the flowchart of FIG. 6.

For each cylinder 3 of the engine 2, misfire is monitored at an engine start by the corresponding detection part at misfire 4. If misfire is detected (step S1), a misfire detection signal is inputted from the cylinder 3 in which misfire is occurring into the measurement part 51 of the misfire controller 5.

The torsional vibration vibratory force applied to the crank of each cylinder is proportional to the amplitude ratio, and the generated torsional vibration vibratory forces are varied depending on the position of the cylinder 3 with misfire. Thus, the measurement part 51 can obtain the torsion angle from the amplitude ratio corresponding to the vibratory force (step S2).

The torsional vibration vibratory force is obtained from the torsion angle of the crank shaft obtained by the measurement part 51, and the vector sum VS of the crank-shaft torsional vibration vibratory force has a predetermined value of the crank-shaft torsional vibration during misfire as compared to during normal ignition, similarly to the first embodiment. Thus, subsequently in step S3, the crank-shaft additional stress calculation part 52 can calculate crank-shaft additional stress (MPa) at this time.

Next, the additional stress extraction part 54 can extract the output limit rate corresponding to the crank-shaft additional stress with reference to the crank-shaft additional stress obtained by the crank-shaft additional stress calculation part 52 and the data part on map 53.

Specifically, since an engine output limit rate (%) corresponding to the crank-shaft additional stress (MPa) is accumulated in advance in the data part on map 53, it is possible to extract a suitable output limit rate if the crank-shaft additional stress is known.

Further, the engine output control part 55 can control the operation output of the engine on the basis of the output limit rate from the additional stress extraction part 54 (step S5).

Then, from the engine output control part 55, an engine output load control signal is outputted on the basis of the additional stress limit amount, and it is possible to control the amount of fuel injection and the timing of fuel injection via the fuel injection control part 6.

According to the second embodiment, it is possible to calculate crank-shaft additional stress upon occurrence of misfire by measuring a torsion angle of the crank with the measurement part and then calculating vibration from the torsion angle of the crank shaft obtained with the measurement part with the crank-shaft additional stress calculation part. Then, the additional-stress extraction part extracts the output limit rate to be limited from the calculated crank-shaft additional stress and the data part on map of the output limit rate corresponding to crank-shaft additional stress determined in advance. On the basis of such output limit rate, it is possible to control the operation output of the engine with the engine output control part.

As a result, it is possible to avoid unnecessary output limit with respect to the allowable operation output for the purpose of continuing stable operation of an engine during occurrence of misfire. Further, it is possible to improve the utilization rate of the engine as compared to a conventional technique, and it is possible to improve the fuel consumption rate by avoiding unnecessary low-load operation of the engine, thereby improving the efficiency of the engine power generation plant.

INDUSTRIAL APPLICABILITY

According to the present invention, it is possible to provide a method and a device of controlling load during misfire of an engine whereby, in a case where misfire occurs to one cylinder or a plurality of cylinders, torsional vibration caused by occurrence of misfire is evaluated, additional stress is obtained, and the operation output of the engine is controlled from the output limit rate corresponding to the additional stress to the minimum operation output. In this way, it is possible to restrict a decrease in utilization rate of the engine upon occurrence of misfire, and to restrict a decrease in the efficiency of the engine power generation plant accompanying deterioration in the fuel consumption rate of the engine.

| Description of Reference Numerals | |
|---|---|
| 1 | Load control system at misfire |
| 2 | Engine |
| 3 | Cylinder |
| 4 | Detection part at misfire |
| 5 | Misfire controller |
| 6 | Fuel injection control part |
| 7 | Fuel injector |
| 8 | Crank-shaft additional stress calculation part |
| 9 | Crank-shaft additional stress determination part |
| 10 | Engine output reduction command part |
| 11 | Additional stress limit amount calculation part |
| 12 | Engine output control part |
| 51 | Measurement part |
| 52 | Crank-shaft additional stress calculation part |
| 53 | Data part on map |
| 54 | Additional stress extraction part |
| 55 | Engine output control part |

The invention claimed is:

1. A method of controlling a load during misfire of an engine for detecting misfire of a cylinder of an engine including a plurality of cylinders and controlling an operation output of the engine on the basis of a detection result of the misfire, the method comprising:

a first step of calculating additional stress on a crank shaft on the basis of crank-shaft torsional vibration evaluation calculation when the misfire is detected;

a second step of obtaining an output limit rate for the engine corresponding to the calculated additional stress on the crank shaft; and a third step of controlling the operation output of the engine on the basis of the output limit rate, wherein the second step includes determining whether the calculated additional stress on the crank shaft is less than an allowable stress with respect to the crank shaft, and performing a control for reducing the operation output of the engine by a predetermined amount and returning to the first step to execute the first step repeatedly if the calculated additional stress is greater than the allowable stress or calculating the additional stress on the crank shaft to obtain the output limit rate if it is determined that the calculated additional stress on the crank shaft is less than the allowable stress with respect to the crank shaft.

2. The method of controlling a load during misfire of an engine according to claim 1, wherein the crank-shaft torsional vibration evaluation calculation in the first step is for calculating the additional stress on the crank shaft on the basis of a vector sum of a crank-shaft torsional vibration vibratory force.

3. The method of controlling a load during misfire of an engine according to claim 1, wherein the crank-shaft torsional vibration evaluation calculation in the first step is for calculating the additional stress on the crank shaft on the basis of a torsion angle of the crank shaft.

4. The method of controlling a load during misfire of an engine according to claim 1, wherein, in the second step, the output limit rate is obtained on the basis of the calculated additional stress on the crank shaft and map data of an output limit rate corresponding to crank-shaft additional stress determined in advance.

5. A system for controlling a load during misfire of an engine configured to detect misfire of a cylinder of an engine including a plurality of cylinders and control an operation output of the engine on the basis of a detection result of the misfire, the system comprising:

a crank-shaft additional stress calculation part configured to calculate additional stress on a crank shaft on the basis of crank-shaft torsional vibration evaluation calculation when the misfire is detected;

an additional-stress limit amount calculation part configured to obtain an output limit rate for the engine corresponding to the calculated additional stress on the crank shaft; and an engine output control part configured to control the operation output of the engine on the basis of the output limit rate for the engine calculated by the additional-stress limit amount calculation part, wherein the additional-stress limit amount calculation part is configured to determine whether the calculated additional stress on the crank shaft is less than an allowable stress with respect to the crank shaft, and to issue a command to reduce the operation output of the engine by a predetermined amount if the calculated additional stress on the crank shaft is greater than the allowable stress or calculate the additional stress on the crank shaft if it is determined that the calculated additional stress on the crank shaft is less than the allowable stress with respect to the crank shaft.

6. The system for controlling a load during misfire of an engine according to claim 5, wherein the crank-shaft additional stress calculation part is configured to calculate the additional stress on the crank shaft on the basis of a vector sum of a crank-shaft torsional vibration vibratory force.

7. The system for controlling a load during misfire of an engine according to claim 5, wherein the crank-shaft additional stress calculation part is configured to calculate the additional stress on the crank shaft on the basis of a torsion angle of the crank shaft.

8. The system for controlling a load during misfire of an engine according to claim 5, wherein the additional-stress limit calculation part is configured to extract the output limit rate corresponding to the additional stress on the crank shaft, referring to the calculated additional stress on the crank shaft calculated by the crank-shaft additional stress calculation part and a data part on map of an output limit rate corresponding to crank-shaft additional stress determined in advance.

* * * * *